United States Patent [19]

Kim

[11] 4,453,060

[45] Jun. 5, 1984

[54] SWITCH BLADE COVER

[75] Inventor: Syng N. Kim, Hoffman Estates, Ill.

[73] Assignee: Wico Corporation, Niles, Ill.

[21] Appl. No.: 414,966

[22] Filed: Sep. 7, 1982

[51] Int. Cl.[3] ..... H01H 9/04

[52] U.S. Cl. ..... 200/302.1; 200/283

[58] Field of Search ..... 200/283, 302, 304, 305

[56] References Cited

U.S. PATENT DOCUMENTS

| | | | |
|---|---|---|---|
| 2,251,056 | 7/1941 | Irwin | 200/304 |
| 2,318,761 | 5/1943 | Curtis | 200/305 |
| 2,562,090 | 7/1951 | Harrison | 200/302 |
| 2,607,865 | 8/1952 | Gray | 200/283 |
| 3,284,586 | 11/1966 | Gover | 200/302 |
| 4,300,025 | 11/1981 | Prada | 200/283 |

FOREIGN PATENT DOCUMENTS

| | | | |
|---|---|---|---|
| 35259 | 7/1956 | Fed. Rep. of Germany | 200/283 |
| WO78/00004 | 1/1980 | PCT Int'l Appl. | 200/302 |

*Primary Examiner*—John W. Shepperd

*Attorney, Agent, or Firm*—Emrich & Dithmar

[57] ABSTRACT

A covered leaf switch assembly includes a switch body having resilient switch blades. A molded plastic cover includes an elongated sheath for receiving the blades therein and a coupling portion for interfitting with the switch body. In one embodiment the coupling portion has a pair of arms with fingers and ribs receivable in complementary grooves and notches on the switch body. In another embodiment the coupling portion includes a jacket frictionally receiving the switch body therein.

13 Claims, 8 Drawing Figures

SWITCH BLADE COVER

BACKGROUND OF THE INVENTION

The present invention relates to electrical leaf switches and, in particular, to means for providing protection therefor.

Leaf switches are commonly used in all types of electrical and mechanical devices, and include two resilient leafs or blades carrying contact buttons which are normally spaced-apart. The blades are deflectable toward each other for closing the switch contacts. The environments in which leaf switches are used are commonly dirty and frequently result in buildup of dust, grease or other contaminants on the switch contacts which may interfere with the electrical connection between the contacts and cause malfunctioning of the switch.

SUMMARY OF THE INVENTION

It is a general object of this invention to provide a protective cover for leaf switch blades which will shield them from contaminants which might interfere with operation of the switch.

It is another object of this invention to provide a cover of the type set forth which does not interfere with normal deflection of the switch blades in operation.

Still another object of this invention is the provision of a switch blade cover of the type set forth which is of simple and economical construction and which can be easily mounted on the switch without the use of tools.

In connection with the foregoing objects, it is another object of this invention to provide an assembly of a leaf switch and a cover therefor of the type set forth.

These and other objects of the invention are attained by providing a cover for a leaf switch including a body carrying a plurality of switch blades, the cover comprising: a sheath having an open end and a closed end and being adapted to receive all of the switch blades therein through the open end, and coupling means on the open end for interfitting with the body for cooperation therewith completely to enclose the switch blades.

The invention consists of certain novel features and a combination of parts hereinafter fully described, illustrated in the accompanying drawings, and particularly pointed out in the appended claims, it being understood that various changes in the details may be made without departing from the spirit, or scarificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
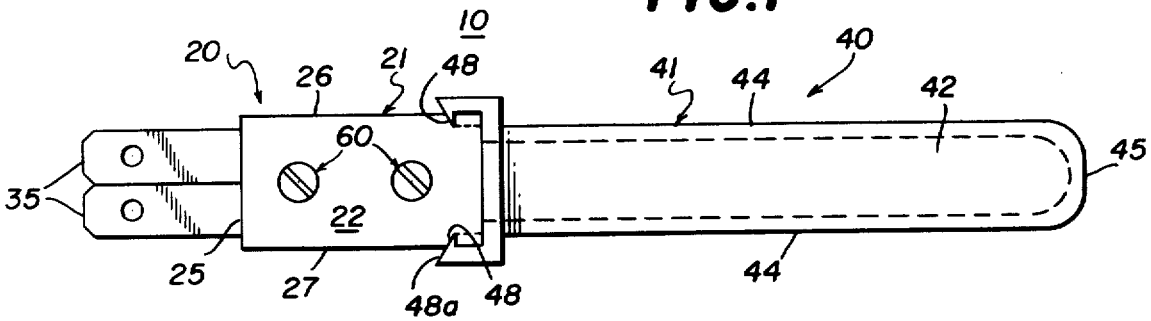
FIG. 1 is a top plan view of an assembly of a leaf switch and a cover constructed in accordance with and embodying the features of a first embodiment of the present invention.
Figure 2:
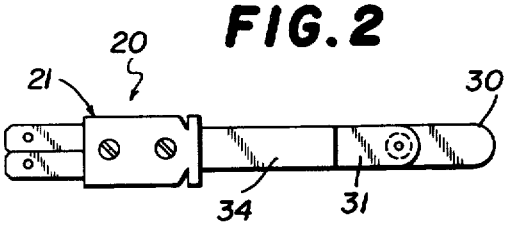
FIG. 2 is a reduced top plan view of the switch of FIG. 1, with the cover removed.
Figure 3:
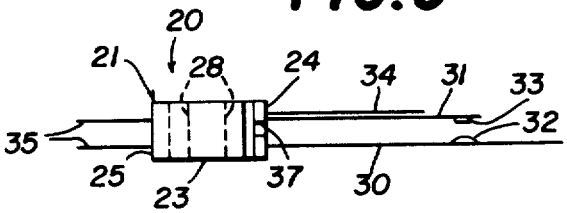
FIG. 3 is a side elevational view of the switch illustrated in FIG. 2.
Figure 4:
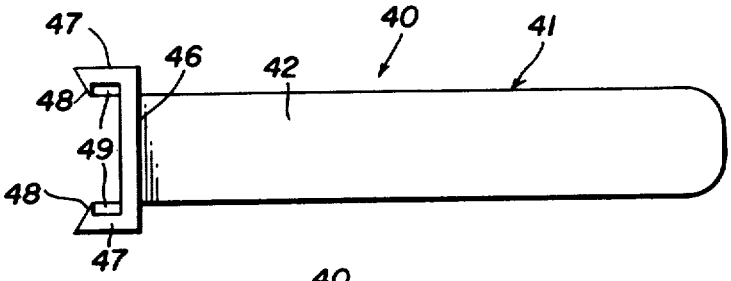
FIG. 4 is a top plan view of the blade cover illustrated in FIG. 1.
Figure 5:
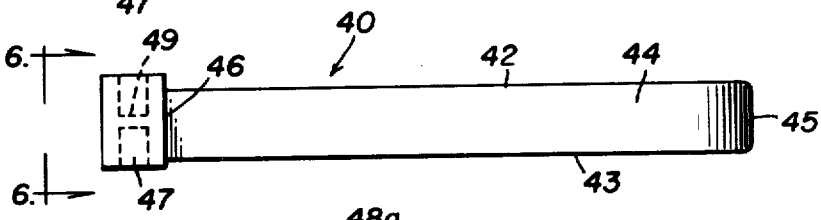
FIG. 5 is a side elevational view of the cover of FIG. 4.
Figure 6:
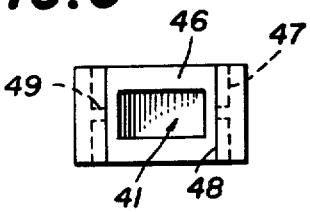
FIG. 6 is an end elevational view of the cover of FIG. 5, taken along the line 6—6 therein.

Referring to FIG. 1 of the drawings, there is illustrated a covered switch assembly, generally designated by the numeral 10, which includes a leaf switch 20, the blades of which are covered by a cover 40 constructed in accordance with and embodying the features of the first embodiment of the present invention. Referring also to FIGS. 2 and 3 of the drawings, the leaf switch 20 includes a body 21 of electrically insulating material which is substantially in the form of a hexahedron and includes a top surface 22, a bottom surface 23, opposed end surfaces 24 and 25 and opposed side surfaces 26 and 27. Two bores 28 extend through the body 21 from the top surface 22 to the bottom surface 23 thereof. Projecting from the end surface 24 are an elongated, flexible, resilient, electrically conductive leaf or blade 30 and a shorter conductive leaf or blade 31 spaced from the blade 30 and parallel thereto. Respectively formed on the facing surfaces of the blades 30 and 31 are contact buttons 32 and 33 disposed for engagement with each other when the blades 30 and 31 are deflected together. A flexible, resilient metal backing plate 34 overlies the blade 31 in contact therewith. Preferably, the blades 30 and 31 extend all the way through the body 21 and are respectively provided with contact terminals 35 which project from the end surface 25 of the body 21 for connection to associated circuitry. Each of the side surfaces 26 and 27 has formed therein adjacent to the end surface 24 an elongated groove 36 which extends from the top surface 22 to the bottom surface 23. Also formed in each of the side surfaces 26 and 27 is a short notch 37 which extends from the end surface 24 to the corresponding one of the grooves 36 perpendicular thereto and intermediate the ends thereof.

Referring now also to FIGS. 4 through 7 of the drawings, the cover 40 is of integral one-piece construction, preferably being molded of plastic, and includes an elongated flexible sheath 41 which has parallel top and bottom walls 42 and 43 interconnected at the edges thereof by parallel side walls 44, the walls 42–44 being closed at one end thereof by a rounded end wall 45. Extending laterally outwardly from the sheath 41 at the open end thereof around the entire perimeter thereof is a collar flange 46. Integral with the collar flange 46 at the opposite sides thereof and projecting forwardly therefrom away from the sheath 41 and substantially parallel to the side walls 44 are two rectangular, flexible arms 47, each being provided at the distal end thereof with a laterally inwardly projecting finger 48. Formed along the outer end of each of the fingers 48 is an inclined cam surface 48*a* which slopes laterally inwardly and toward the collar flange 46. Integral with each of the arms 47 along the inner surface thereof and projecting laterally inwardly therefrom is a short rib 49 which extends from the corresponding finger 48 to the collar flange 46.

Figure 7:
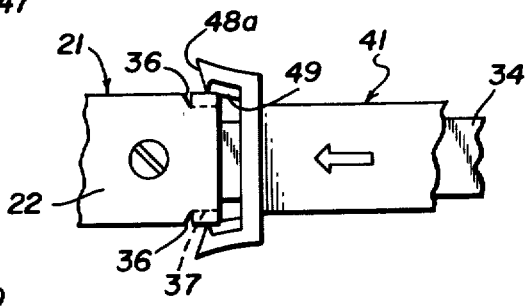
FIG. 7 is a fragmentary view similar to FIG. 1 illustrating the manner of mounting the cover on the switch.

In use, the sheath 41 is fitted over the switch blades 30 and 31 and the backing plate 34. The arms 47 are flexible and resilient and the cam surfaces 48*a* are positioned to engage the end surface 24 of the switch body 21 for resiliently deflecting the arms 47 laterally outwardly, as indicated in FIG. 7. As the cover 40 is pushed further toward the body 21 in the direction of the arrow in FIG. 7, the fingers 48 will respectively snap into the grooves 36 to prevent retrograde movement of the cover 40, thereby securely interlocking the cover 40 and the switch body 21. The ribs 49 are respectively accommodated in the notches 37 to prevent top to bottom wobbling movement of the cover 40 with respect to the switch body 21. When thus assembled into the mounting position illustrated in FIG. 1, the cover 40 cooperates with the switch body 21 completely to enclosed the switch blades 30 and 31 effectively to protect them from contaminants. The sheath 41 is, however, flexible enough to permit normal deflection of the switch blades 30 and 31. When it is desired to remove the cover 40, the fingers 48 are pried outwardly by use of the exposed portions of the cam surface 48*a*, for disengaging the fingers 48 from the grooves 36.

Figure 8:
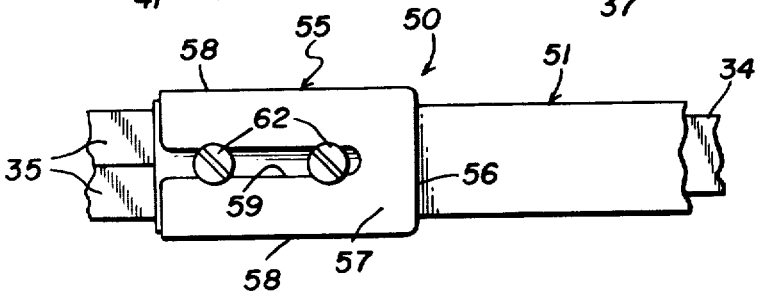
FIG. 8 is a fragmentary view similar to FIG. 1, illustrating an assembly of the switch with a cover according to a second embodiment of the present invention.

Referring now to FIG. 8 of the drawings, there is illustrated an alternative embodiment of the cover in accordance with the present invention, generally designated by the numeral 50. The cover 50 includes an elongated sheath 51 which is substantially identical to the sheath 41 of the cover 40. Integral with the sheath 51 at the open end thereof is a coupling jacket, generally designated by the numeral 55 which includes a collar flange 56 projecting laterally outwardly from the sheath 41 around the entire perimeter thereof and being in turn integral with a top wall 57, a bottom wall (not shown) and a pair of opposed side walls 58 which cooperate to define a jacket or sleeve dimensioned for receiving frictionally therein the switch body 21.

Preferably, the top wall 57 has formed therein an elongated slot 59 extending from the open end thereof substantially parallel to the longitudinal axis of the leaf switch 20. The leaf switch 20 is also provided with a pair of screws 60 (see FIG. 1) which are respectively adapted to be received through the bores 28 securely to fasten a switch body 21 to an associated support. The width of the slot 59 is about the same as the diameter of the shanks of the screws 60, but is substantially less than the diameter of the screw heads 62. Accordingly, the screw heads 62 will cooperate with the switch body 21 securely to clamp therebetween the top wall 57 of the coupling jacket 55, thereby securely to fasten the cover 50 in place on the leaf switch 20.

In constructional models of the present invention, the covers 40 and 50 are preferably each molded of suitable plastic such as polypropylene, although it will be appreciated that other electrically insulating materials of adequate flexibility could be used.

From the foregoing, it can be seen that there has been provided an improved switch blade cover which is of simple and economical construction and can readily be mounted to a leaf switch without the use of tools for completely enclosing the switch blades.

I claim:

1. A cover for a leaf switch including a body carrying a plurality of resilient switch blades, said cover comprising: a flexible continuous sheath having an open end and a closed end and being adapted to closely receive all of the switch blades therein through said open end, and an enlarged coupling jacket connected to said sheath at said open end for releasably receiving said body therein for support solely thereby, said sheath cooperating with said body and with said coupling jacket completely to enclose the switch blades while permitting deflection of the switch blades by deflection of said sheath.

2. The cover of claim 1, wherein said coupling means is a jacket having one pair of parallel end walls and a pair of parallel side walls.

3. The cover of claim 2, wherein the switch body is provided with a fastener having an elongated shank and an enlarged head for attachment of the body to an associated support, at least one of said walls having an elongated slot therein for receiving therethrough only the shank of the fastener, the head of the fastener cooperating with the body securely to clamp said one wall thereto.

4. The cover of claim 1, wherein said coupling means comprises spaced apart arms movable away from each other to accommodate the body therebetween, said arms being biased toward each other so that release thereof causes said arms to grasp said body.

5. The cover of claim 4, wherein each of said arms has a cam surface thereon engageable with the body to effect the movement of said arms away from each other.

6. The cover of claim 1, wherein said sheath and said coupling means are joined together in a unitary one-piece construction.

7. The cover of claim 1, wherein said sheath and said coupling means are formed of of electrically insulating material.

8. The combination comprising: a leaf switch including a body carrying a plurality of switch blades, said body having a pair of oppositely facing walls each having a groove therein, each of said walls having a short notch therein communicating with the associated groove, and a cover including a flexible continuous sheath having an open end and a closed end and being adapted to receive all of said switch blades therein through said open end for enclosing said switch blades while accommodating deflection thereof by deflection of said sheath, and two arms adjacent to said open end of said sheath spaced apart a distance about the same as the distance between said walls, each of said arms carrying an inwardly directed finger and having a rib formed on the inner surface thereof and extending substantially perpendicular to the corresponding finger, said arms being resiliently movable away from each other to accommodate said body therebetween, said arms being biased toward each other so that said fingers respectively engage in said grooves with said ribs being respectively received in said notches for interlocking said cover and said body in a mounted configuration.

9. The combination of claim 8, wherein said sheath and said arms are formed of electrically insulating material.

10. The combination of claim 8, wherein said sheath and said arms are formed together in a unitary one-piece construction.

11. The combination of claim 8, wherein each of said fingers has a cam surface thereon engageable with the corresponding one of said body walls for moving said arms away from each other.

12. The combination comprising: a leaf switch including a body carrying a plurality of switch blades, a fastener having an elongated shaft and an enlarged head and receivable through said body for attachment thereof to an associated support, a cover including a flexible continuous sheath having an open end and a closed end and being adapted to closely receive all of said switch blades therein through said open end for enclosing said switch blades while accommodating deflection thereof by deflection of said sheath, and an enlarged coupling jacket connected to said sheath at the open end thereof and dimensioned for receiving said body therein, said coupling jacket having a slot therein dimensioned for receiving therethrough only the shank of said fastener, said head of said fastener cooperating with said body for releasably clamping said coupling jacket therebetween to provide the sole support for said sheath.

13. The combination of claim 12, wherein said coupling jacket and said sheath are formed together in a unitary one-piece construction.

* * * * *